US012703957B2

(12) United States Patent
Shin et al.

(10) Patent No.: US 12,703,957 B2
(45) Date of Patent: Aug. 11, 2026

(54) CONSTRUCTION EQUIPMENT

(71) Applicant: Volvo Construction Equipment AB, Eskilstuna (SE)

(72) Inventors: Hungju Shin, Gyeongsangnam-do (KR); Miok Kim, Busan (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 859 days.

(21) Appl. No.: 17/971,738

(22) Filed: Oct. 24, 2022

(65) Prior Publication Data

US 2023/0137581 A1 May 4, 2023

(30) Foreign Application Priority Data

Oct. 29, 2021 (KR) ..... 10-2021-0146645

(51) Int. Cl.
*E02F 3/43* (2006.01)
*E02F 3/30* (2006.01)
*E02F 9/12* (2006.01)

(52) U.S. Cl.
CPC ..... *E02F 3/431* (2013.01); *E02F 3/30* (2013.01); *E02F 9/121* (2013.01)

(58) Field of Classification Search
CPC . E02F 3/30; E02F 9/121; E02F 9/2235; E02F 9/2228; E02F 3/435; E02F 3/43;
(Continued)

(56) References Cited

U.S. PATENT DOCUMENTS

2011/0000722 A1* 1/2011 Kawashima ..... B60W 10/06 180/65.285
2013/0125537 A1* 5/2013 Kim ..... F15B 15/20 60/327

(Continued)

FOREIGN PATENT DOCUMENTS

WO WO-2020204238 A1 * 10/2020 ..... E02F 9/262

OTHER PUBLICATIONS

Extended European Search Report for EP Patent Application No. 22203874.7, mailed Apr. 3, 2023, 8 pages.

*Primary Examiner* — Kito R Robinson
*Assistant Examiner* — Erin Marie Hartmann
(74) *Attorney, Agent, or Firm* — Sage Patent Group

(57) ABSTRACT

A construction equipment includes a lower traveling body; an upper rotating body rotatably supported on the lower traveling body; a work machine which includes a boom, an arm, and a bucket operated by their respective hydraulic cylinder, wherein the work machine is supported by the upper rotating body; a control valve for controlling the hydraulic cylinder; an electronic proportional pressure reducing valve for controlling the spool of the control valve; an operation lever for outputting an operation signal corresponding to an operation amount of a driver; an information providing unit for providing information on the work machine and the work surface; and an electronic control unit for calculating and outputting a pilot pressure for the electronic proportional pressure reducing valve, wherein the electronic control unit controls the speed of the hydraulic cylinder by using the operation signal of the operation lever and the information provided by the information providing unit.

7 Claims, 8 Drawing Sheets

(58) Field of Classification Search
CPC ..... E02F 9/2004; E02F 9/22; E02F 9/2203;
E02F 9/2285; E02F 9/265; E02F 3/431
See application file for complete search history.

(56) References Cited

U.S. PATENT DOCUMENTS

| | | | | |
|---|---|---|---|---|
| 2016/0069044 | A1 | 3/2016 | Takaura et al. | |
| 2019/0078290 | A1 | 3/2019 | Yamada et al. | |
| 2020/0232186 | A1 | 7/2020 | Nakano et al. | |
| 2021/0262191 | A1* | 8/2021 | Ito ..... | E02F 9/205 |

* cited by examiner (a)

(b)

(a)

(b)

CONSTRUCTION EQUIPMENT

CROSS REFERENCE TO RELATED APPLICATIONS

The present application claims benefit of priority to Korean Patent Application No. 10-2021-0146645, filed Oct. 29, 2021, and is assigned to the same assignee as the present application and is incorporated herein by reference in its entirety.

TECHNICAL FIELD

The present disclosure relates to a construction equipment. More specifically, the present disclosure relates to a construction equipment which controls the speed of an arm or a boom in consideration of an angle of an arm with respect to a work surface, a moment of inertia of a work machine, and an engine output.

BACKGROUND

In general, an excavator is a construction equipment performing various tasks such as digging for digging up the ground at construction sites, etc., loading for carrying soil, excavating for making a foundation, crushing for dismantling buildings, grading for cleaning the ground, and leveling for leveling the ground, etc.

SUMMARY

The present disclosure is to solve the above-mentioned problems of the prior art. It is an object of the present disclosure to provide a construction equipment which can lift or lower the boom in accordance with the movement amount of the arm by controlling the speed of the arm or the boom based on the speed required for driving the boom, the moment of inertia of the work machine, and the engine output.

An aspect of the present disclosure provides a construction equipment, comprising: a lower traveling body; an upper rotating body rotatably supported on the lower traveling body; a work machine which comprises a boom, an arm, and a bucket operated by their respective hydraulic cylinder, wherein the work machine is supported by the upper rotating body; a control valve for controlling the hydraulic cylinder; an electronic proportional pressure reducing valve for controlling the spool of the control valve; an operation lever for outputting an operation signal corresponding to an operation amount of a driver; an information providing unit for providing information on the work machine and the work surface; and an electronic control unit for calculating and outputting a pilot pressure for the electronic proportional pressure reducing valve, wherein the electronic control unit controls the speed of the hydraulic cylinder by using the operation signal of the operation lever and the information provided by the information providing unit.

In an embodiment, the information providing unit may provide at least one of the speed required for driving the boom, the moment of inertia of the work machine, and the engine maximum output to the electronic control unit.

In an embodiment, the electronic control unit may compare the speed required for driving the boom with a reference value.

In an embodiment, the electronic control unit may set a predetermined set value as the arm speed increase rate when the speed required for driving the boom is less than or equal to a reference value, and the electronic control unit may set a value smaller than the set value as the arm speed increase rate when the speed required for driving the boom exceeds a reference value.

In an embodiment, the electronic control unit may set the arm speed increase rate to decrease as the speed required for driving the boom increases.

In an embodiment, the electronic control unit may compare the moment of inertia of the work machine with a reference value.

In an embodiment, the electronic control unit may set a predetermined set value as the arm speed increase rate when the moment of inertia of the work machine is less than or equal to a reference value, and the electronic control unit may set a value smaller than the set value as the arm speed increase rate when the moment of inertia of the work machine exceeds a reference value.

In an embodiment, the electronic controller may compare the engine maximum output with a reference value.

In an embodiment, the electronic control unit may set a predetermined set value as the arm speed increase rate when the engine maximum output is greater than or equal to a reference value, and the electronic control unit may set a value smaller than the set value as the arm speed increase rate when the engine maximum output is less than a reference value.

In an embodiment, the information providing unit may provide the speed required for driving the boom, the moment of inertia of the work machine, and the engine maximum output to the electronic control unit, the electronic control unit may compare the speed required for driving the boom, the moment of inertia of the work machine, and the engine maximum output with a reference value, the electronic control unit may set a predetermined first set value as the first arm speed increase rate when the speed required for driving the boom is less than or equal to a reference value, and the electronic control unit may set a value obtained by multiplying the first set value by the first decrease rate as the first arm speed increase rate when the speed required for driving the boom exceeds a reference value, the electronic control unit may set a predetermined second set value as the second arm speed increase rate when the moment of inertia of the work machine is less than or equal to a reference value, and the electronic control unit may set a value obtained by multiplying the second set value by the second decrease rate as the second arm speed increase rate when the moment of inertia of the work machine exceeds a reference value, and the electronic control unit may set a predetermined third set value as the third arm speed increase rate when the engine maximum output is greater than or equal to a reference value, and the electronic control unit may set a value obtained by multiplying the third set value by the third decrease rate as the third arm speed increase rate when the engine maximum output is less than a reference value.

In an embodiment, the electronic controller may set a smallest value among the first arm speed increase rate to the third arm speed increase rate as the arm speed increase rate.

In an embodiment, the electronic controller may set a value obtained by multiplying any one of the first set value to the third set value by the first decrease rate to the third decrease rate as the arm speed increase rate.

In an embodiment, the information providing unit may provide the speed required for driving the boom, the moment of inertia of the work machine, and the engine maximum output to the electronic control unit, the electronic control unit may compare the speed required for driving the boom, the moment of inertia of the work machine, and the engine maximum output with a reference value, the electronic control unit may set a predetermined first set value as the first boom speed increase rate when the speed required for driving the boom is less than or equal to a reference value, and the electronic control unit may set a value greater than the first set value as the first boom speed increase rate when the speed required for driving the boom exceeds a reference value, the electronic control unit may set a predetermined second set value as the second boom speed increase rate when the moment of inertia of the work machine is less than or equal to a reference value, and the electronic control unit may set a value greater than the second set value as the second boom speed increase rate when the moment of inertia of the work machine exceeds a reference value, and the electronic control unit may set a predetermined third set value as the third boom speed increase rate when the engine maximum output is greater than or equal to a reference value, and the electronic control unit may set a value greater than the third set value as the third boom speed increase rate when the engine maximum output is less than a reference value.

In an embodiment, the electronic control unit may set a largest value among the first boom speed increase rate to the third boom speed increase rate as the boom speed increase rate.

In an embodiment, the operation lever may generate an electric signal in proportion to the operation amount of the driver as an electric joystick to provide the same to the electronic control unit.

According to an aspect of the present disclosure, when a smallest arm speed increase rate is adopted in consideration of all of the speed required for driving the boom, the moment of inertia of the work machine, and the engine maximum output value, the boom may be lifted or lowered in accordance with the movement amount of the arm in various situations. Accordingly, the reliability of arm speed control can be improved.

The effects of the present disclosure are not limited to the above-mentioned effects, and it should be understood that the effects of the present disclosure include all effects that could be inferred from the configuration of the disclosure described in the detailed description of the disclosure or the appended claims.

BRIEF DESCRIPTION OF DRAWINGS

FIGS. 4A to 6B are schematic diagrams for explaining an example of an excavation work of a construction equipment according to an embodiment of the present disclosure; and FIGS. 7A to 8B are schematic diagrams illustrating arm driving speed graphs according to an embodiment of the present disclosure.

DETAILED DESCRIPTION

Figure 1:
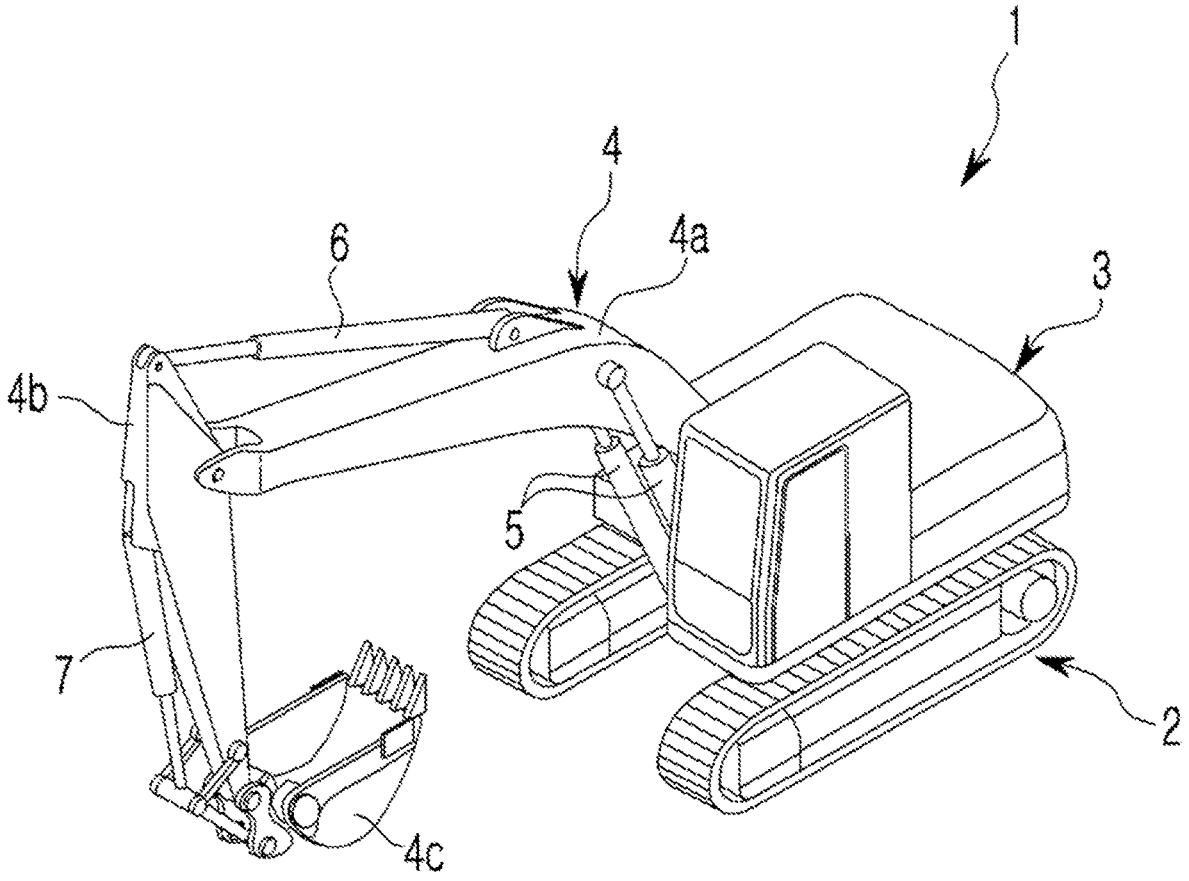
FIG. 1 is a perspective view illustrating a basic configuration of a construction equipment.

Hereinafter, the present disclosure will be explained with reference to the accompanying drawings. The present disclosure, however, may be modified in different ways, and should not be construed as limited to the embodiments set forth herein. Also, in order to clearly explain the present disclosure in the drawings, portions that are not related to the present disclosure are omitted, and like reference numerals are used to refer to like elements throughout the specification.

Throughout the specification, it will be understood that when a portion is referred to as being "connected" to another portion, it can be "directly connected to" the other portion, or "indirectly connected to" the other portion having intervening portions present. Also, when a component "includes" an element, unless there is another opposite description thereto, it should be understood that the component does not exclude another element but may further include another element.

The term including an ordinal number like "the first" or "the second" used throughout the specification of the present disclosure may be used to explain various constitutional elements or steps, but the corresponding constitutional elements or steps should not be limited by the ordinal number. The term including the ordinal number should be interpreted only for distinguishing one constitutional element or step from other constitutional elements or steps.

Hereinafter, embodiments of the present disclosure will be explained in detail with reference to the drawings attached.

Referring to FIG. 1, a construction equipment 1 like an excavator comprises a lower traveling body 2, an upper rotating body 3 rotatably installed on the lower traveling body 2, and a work machine 4 installed to vertically operate on the upper rotating body 3.

In addition, the work machine 4, formed in multi-joints, comprises a boom 4*a* whose rear end is rotatably supported in the upper rotating body 3, an arm 4*b* whose rear end is rotatably supported in the front end of the boom 4*a*, and a bucket 4*c* rotatably installed in the front end of the arm 4*b*. Additionally, hydraulic oil is supplied according to a lever operation of a user, and a boom cylinder (5, work actuator), an arm cylinder (6, work actuator), and a bucket cylinder (7, work actuator) operate the boom 4*a*, the arm 4*b*, and the bucket 4*c*, respectively.

The construction equipment 1 as above operates a work machine 4 such as a boom 4*a*, an arm 4*b*, a bucket 4*c*, etc. by a manual operation lever thereof. However, since each of the work machine 4 is connected by a joint part to perform a rotating movement, it requires considerable efforts for a driver to operate each work machine 4 to work a prescribed area.

On the other hand, since the boom cylinder 5 supports the weight of the boom 4*a*, and the arm 4*b* and the bucket 4*c* located at the tip of the boom 4*a*, the load pressure applied to the boom cylinder 5 is greater than that applied to the arm cylinder 6 or the bucket cylinder 7, and the movement amount of the boom 4*a* may not keep up with the movement amount of the arm 4*b* during the excavation work.

Figure 2:
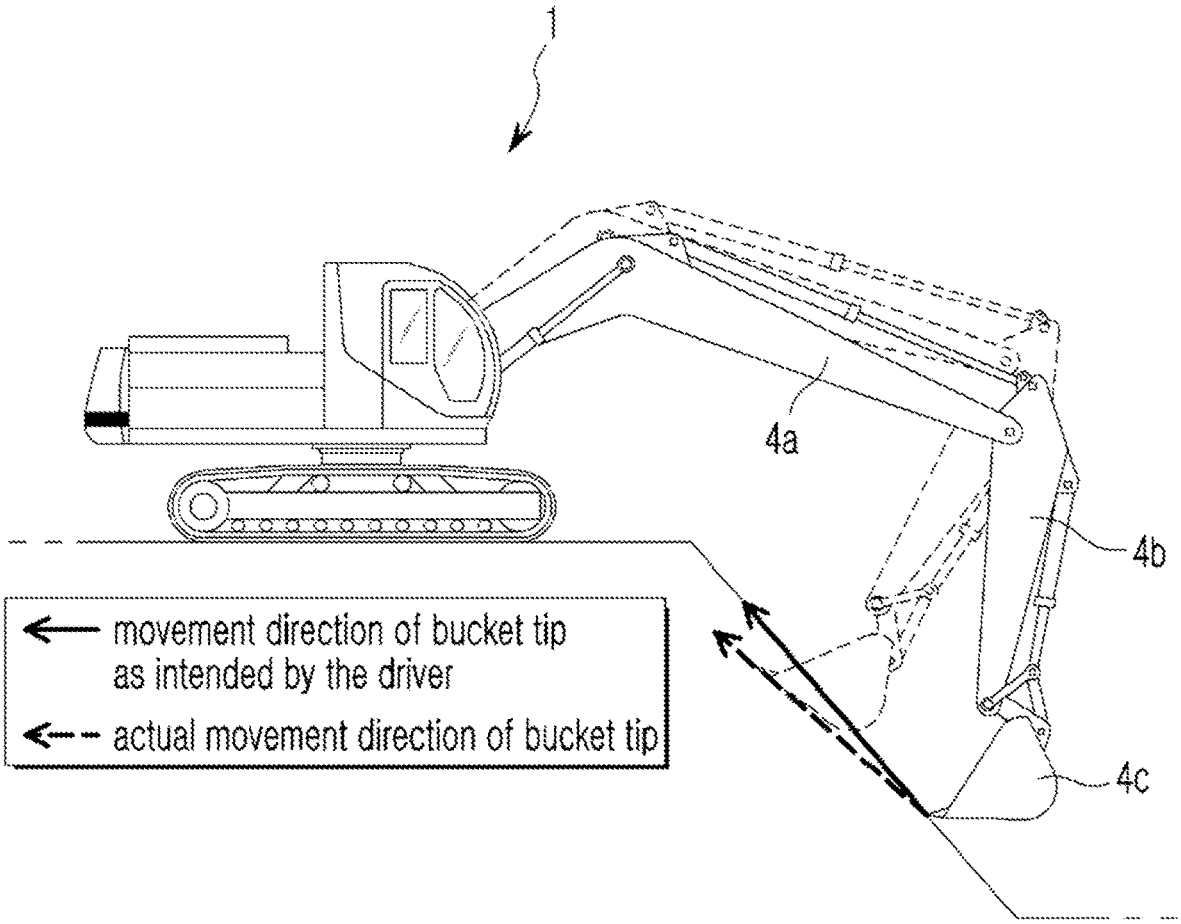
FIG. 2 is a schematic diagram illustrating a state in which the arm of the work machine according to prior art invades the work surface.
Figure 3:
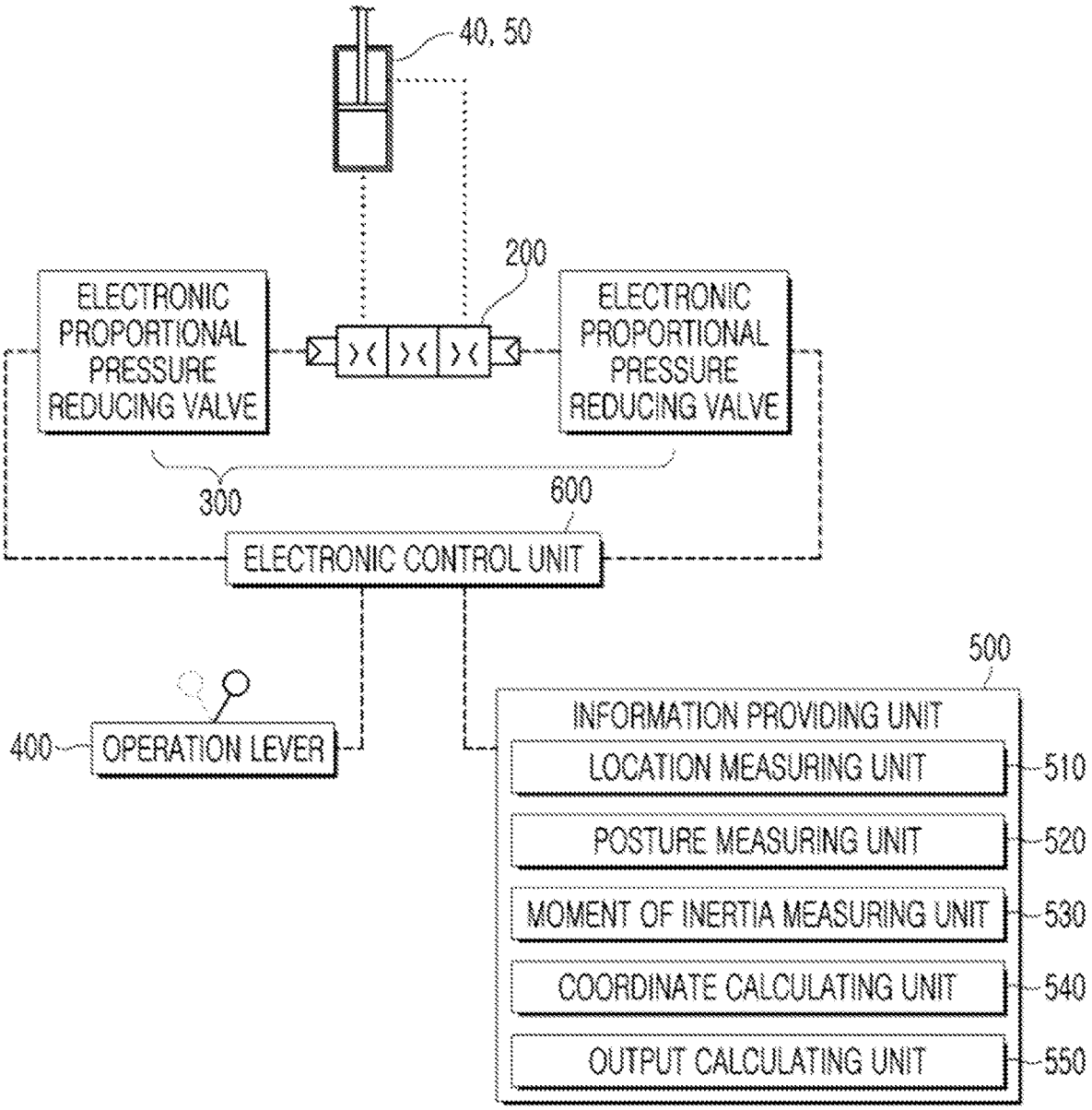
FIG. 3 is a block diagram illustrating a functional configuration of a construction equipment according to an embodiment of the present disclosure.

Specifically, as illustrated in FIG. 2, when performing work while moving the tip of the bucket 4*c* along a work surface including an inclined surface, if the boom 4*a* is not lifted following the movement amount of the arm 4*b*, there are problems such that the tip of the bucket 4*c* may not move in a direction intended by the worker and may invade or escape the work surface. In particular, the above problems occur more often when the angle between the arm 4*b* and the inclined surface is relatively small or the inclination of the inclined surface is steep, and thus a relatively large amount of movement is required for the boom 4*a*.

In addition, in case the bucket 4*c* is in a loaded state or an attachment such as a tilt rotator is mounted on the tip of the arm 4*b* and the moment of inertia with respect to the boom 4*a* increases, when the arm 4*b* is extended to start grading, the boom 4*a* may not be lifted keeping up with the speed at which the arm 4*b* falls due to its own weight.

In addition, when the driver selects standard mode or economy mode for the purpose of improving fuel efficiency, etc., the flow rate, which is the amount of hydraulic oil supplied to the hydraulic cylinder per unit time, is low, and when an instantaneous maximum output is required, the boom 4*a* may not be lifted or lowered following the movement amount of the arm 4*b*.

Referring to FIGS. 3 to 6, a construction equipment 100 having a boom shock mitigation function according to an embodiment of the present disclosure comprises a lower traveling body 10, an upper rotating body 20 rotatably supported on the lower traveling body 10, a work machine 30 which comprises a boom 31, an arm 32, and a bucket 33 operated by their respective hydraulic cylinder, wherein the work machine is supported by the upper rotating body 20, a control valve 200 for controlling the arm cylinder 50, an electronic proportional pressure reducing valve 300 for controlling the spool of the control valve 200, an operation lever 400 for outputting an operation signal corresponding to an operation amount of a driver, an information providing unit 500 for collecting and/or calculating the location information, posture information of the work machine 30 and the location information of the work surface, and an electronic control unit 600 for calculating and outputting a pilot pressure for the electronic proportional pressure reducing valve 300.

The control valve 200 is a member which opens and closes the flow path by a spool moving in the axial direction under pressure. That is, the control valve 200 serves the role of switching the supply direction of the hydraulic oil supplied by the hydraulic pump, which is the hydraulic source, to the boom cylinder 40 and the arm cylinder 50 side. The control valve 200 is connected to the hydraulic pump through a hydraulic pipe, and induces supply of hydraulic oil from the hydraulic pump to the boom cylinder 40 and the arm cylinder 50.

An electronic proportional pressure reducing valve 300 is an electronically operated valve, and may include a solenoid unit which generates an electromagnetic force and a valve unit which is used as a fluid flow path.

The electronic proportional pressure reducing valve 300 generates hydraulic pressure in response to an electrical signal applied by the electronic control unit 600, and the generated hydraulic pressure is transmitted from the electronic proportional pressure reducing valve 300 to the control valve 200. The hydraulic pressure from the electronic proportional pressure reducing valve 300 causes the spool in the control valve 200 to move axially.

More specifically, as the spool moves in the axial direction, the flow rate, which is the amount of hydraulic oil supplied to the boom cylinder 40 and the arm cylinder 50 per unit time, is adjusted. In other words, when the electronic control unit 600 determines that it is difficult for the boom 31 to be lifted or lowered following the movement amount of the arm 32, the electronic proportional pressure reducing valve 300 changes the signal pressure so that the flow supplied to the spool of the control valve 200 increases in accordance with the input of electric signal from the electronic control unit 600.

The operation lever 400 may be a hydraulic joystick or an electric joystick, and may be an electric joystick which generates an electric signal in proportion to the operation amount of the driver and provides the same to the electronic control unit 600.

The information providing unit 500 may comprise at least one of a location measuring unit 510, a posture measuring unit 520, a moment of inertia measuring unit 530, a coordinate calculating unit 540, and an output calculating unit 550.

The location measuring unit 510 may comprise a receiver capable of receiving a signal transmitted from a GPS satellite, and measures location information of the construction equipment from the received signal.

The posture measuring unit 520 measures and/or calculates the location and posture of at least one of the boom 31, arm 32 and bucket 33, angle of main body of the construction equipment 100 and work surface angle, angular velocity of the arm, angular velocity of the boom, etc. by using a plurality of inertial measurement units (IMU), angle sensors, weight sensors, etc. Also, a value of the speed required for driving the boom 31 is calculated based on the angle value of the arm 32, the work surface angle, and the angular velocity value of the arm.

The moment of inertia measuring unit 530 measures and/calculates the load, the moment of inertia, etc. of the boom 31, the arm 32, the bucket 33, and the attachment using a plurality of inertia measuring units (IMUs), weight sensors, etc. For the load and moment of inertia of an attachment such as a tilt rotator, the driver may directly input corresponding values through a display which provides a touch screen function.

The coordinate calculating unit 540 calculates the x, y, z coordinates of at least one of the upper traveling body 20, boom 31, arm 32, bucket 33 and tilt rotator by using the location information measured from the location measuring unit 510 and the posture measuring unit 520.

The output calculating unit 550 provides the maximum output value corresponding to each engine mode to the electronic control unit 600 when the driver operates the engine mode switch provided in the operating room and sets to any one engine mode of a power mode, a standard mode, economy mode. Of course, the engine mode may include other modes.

When an operation signal of the operation lever 400 is input, the electronic control unit 600 receives information from the information providing unit 500 and determines whether the boom 31 is to be lifted or lowered in accordance with the movement amount of the arm 32. Then, the electronic control unit 600 outputs a current signal for controlling the control valve 200 to the electronic proportional pressure reducing valve 300.

A method for controlling the arm of the electronic control unit 600 in consideration of the speed required for driving the boom according to an embodiment of the present disclosure will be explained in detail as follows.

First, when the driver operates the boom 31 or the arm 32 through an operation lever 400, the information providing unit 500 collects and/or calculates the location information, and posture information of the work machine, and the location information of the work surface, and provides the same to the electronic control unit 600.

Specifically, the posture measuring unit 520 calculates the current angle value of the arm 32 and the work surface angle according to the location of the boom 31, arm 32, and bucket 33 using the location information and posture information, calculates the speed required for driving the boom 31 using the angle value of the arm 32, the work surface angle, and angular velocity value of the arm, and provides the same to the electronic control unit 600.

Then, the electronic control unit 600 compares the calculated speed required for driving the boom 31 with a reference value.

When the speed required for driving the boom 31 is less than or equal to a reference value, the electronic control unit 600 classifies the arm 32 into a high-speed section in which the arm 32 drives fast according to a predetermined arm speed increase rate, and when the speed required for driving the boom 31 exceeds a reference value, the electronic control unit 600 classifies the arm 32 into a low-speed section in which the arm 32 drives slowly according to an arm speed increase rate smaller than the predetermined arm speed increase rate.

Figure 4:
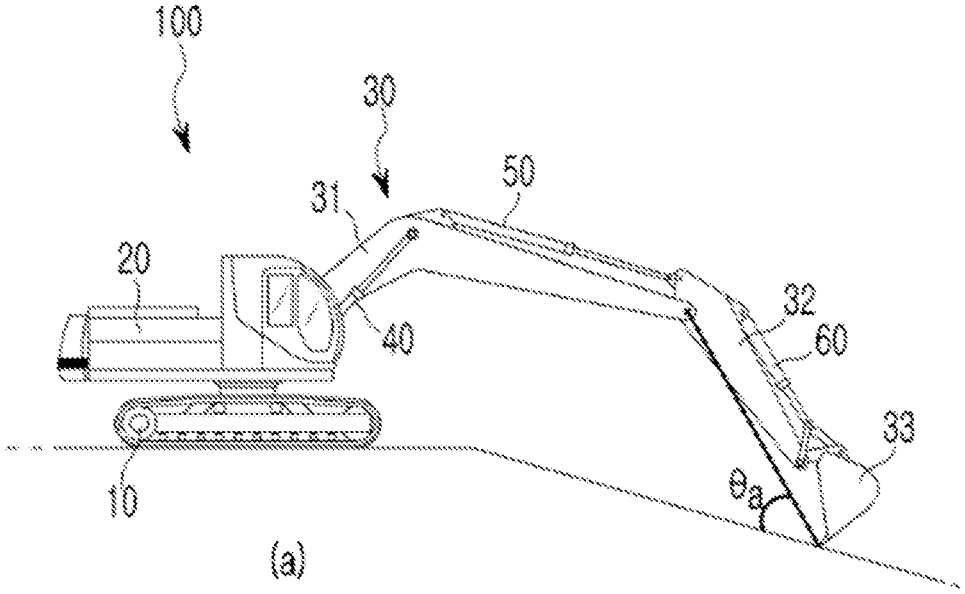
Figure 4:
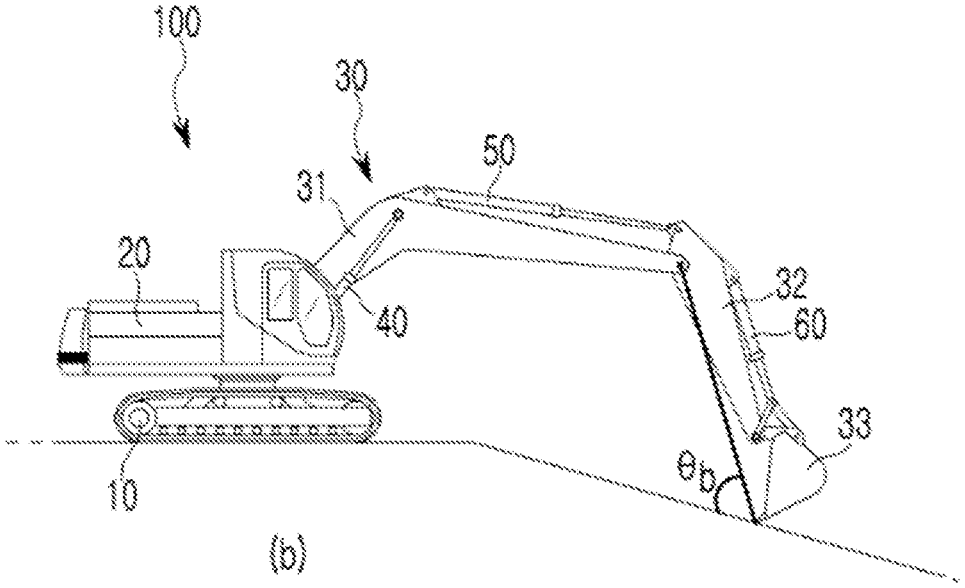

For example, referring to FIG. 4, when performing work while moving the tip of the bucket 33 along a work surface including an inclined surface, as illustrated in FIG. 4(*a*), if the arm 32 rotates in a state in which the angle θa with respect to the work surface is relatively close to horizontal, the boom 31 needs to be lifted a lot so that the arm 32 does not invade the work plane. At this time, the speed required for driving the boom 31 is greater than the reference value.

In this case, it is unreasonable to control the lifting of the boom 31 following the movement amount of the arm 32. Accordingly, the electronic control unit 600 classifies the arm 32 into a low-speed section in which the arm 32 drives slowly according to an arm speed increase rate smaller than the predetermined arm speed increase rate.

On the other hand, as illustrated in FIG. 4(*b*), if the arm 32 rotates in a state in which the angle θb with respect to the work surface is relatively close to vertical in the same work surface as in FIG. 4(*a*), even when the boom 31 is lifted less, the arm 32 does not invade the work surface. At this time, the speed required for driving the boom 31 is smaller than the reference value.

In this case, there is no difficulty in controlling the lifting of the boom 31 following the movement amount of the arm 32. Accordingly, the electronic control unit 600 classifies the arm 32 into a high-speed section in which the arm 32 drives fast according to a predetermined arm speed increase rate.

Figure 5:
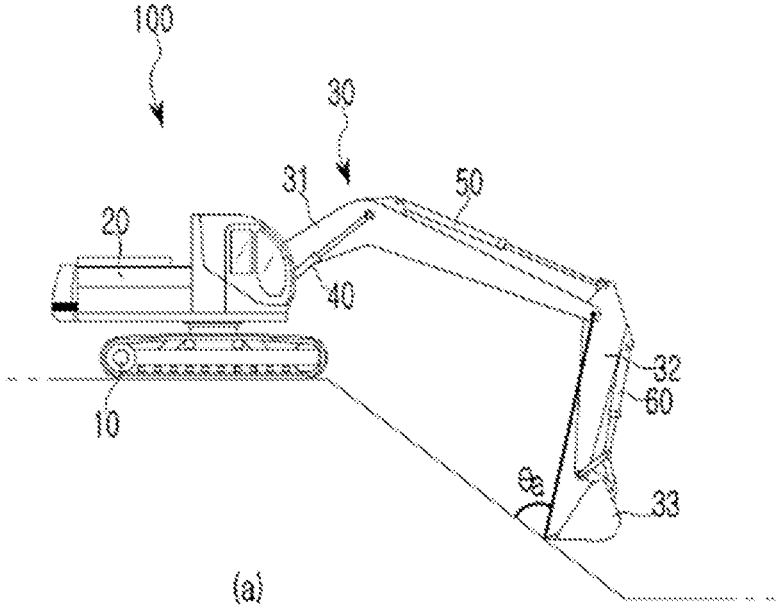
Figure 5:
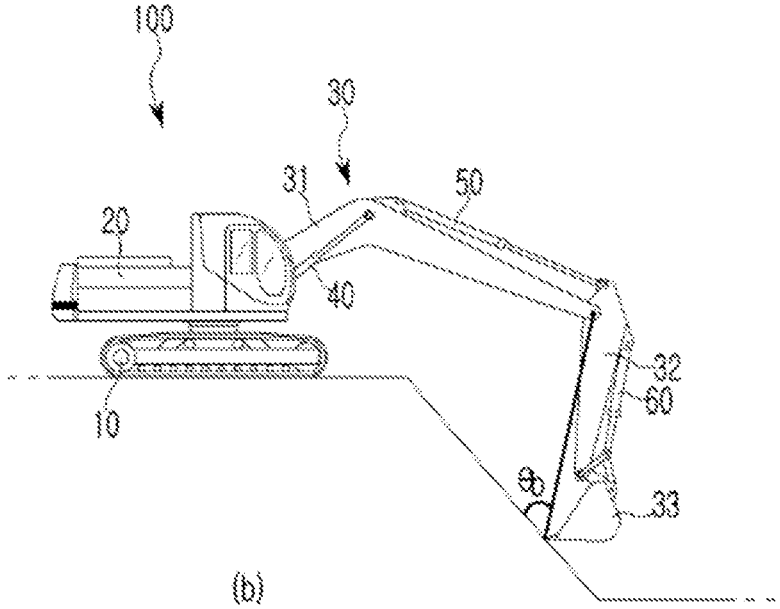

In addition, referring to FIG. 5, when the posture of the work machine 30 is the same, in the case of (b) where the inclination of the work surface is steep, it is unreasonable to control the lifting of the boom 31 following the movement amount of the arm 32 as compared to the case of (a) where the inclination of the work surface is relatively gradual.

In other words, in FIG. 5(*a*), the speed required for driving the boom 31 may be calculated to be smaller than the reference value, and in FIG. 5(*b*), the speed required for driving the boom 31 may be calculated to be greater than the reference value.

Figure 7:
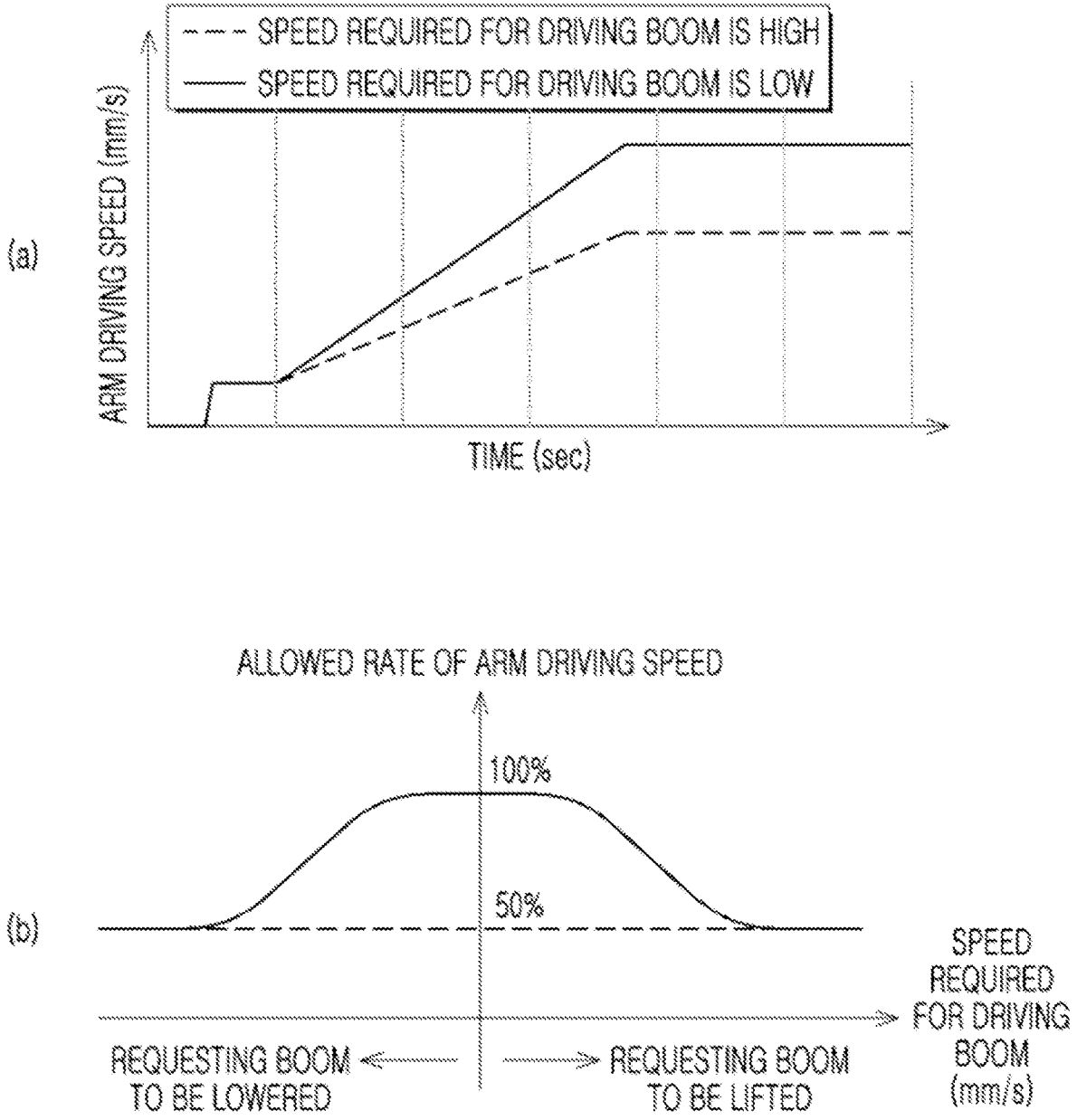

FIG. 7(*a*) illustrates a graph of the speed of the arm 32 according to the operation time of the operation lever 400 according to an embodiment of the present disclosure. Specifically, the electronic control unit 600 sets a predetermined first set value as an arm speed increase rate in a high-speed section in which the speed required for driving the boom 31 is less than or equal to a reference value.

In this case, the electronic proportional pressure reducing valve 300 generates hydraulic pressure corresponding to the pilot pressure input from the electronic control unit 600, and when the generated hydraulic pressure is supplied to the spool of the control valve 200, the spool moves axially. Accordingly, the flow rate, which is the amount of hydraulic oil supplied to the arm cylinder 50 per unit time, is adjusted to increase, and the operation speed of the arm cylinder 50 increases rapidly.

In other words, when the electronic control unit 600 determines that the speed required for driving the boom 31 is less than or equal to a reference value and thus the boom 31 may be lifted or lowered following the movement amount of the arm 32, the speed of the arm 32 is allowed to increase rapidly according to the predetermined first set value.

On the other hand, in a low-speed section in which the speed required for driving the boom 31 exceeds the reference value, since the boom 31 cannot keep up with the speed of the arm 32, the increase rate of the arm speed is controlled to be smaller than the first set value.

In this case, the electronic proportional pressure reducing valve 300 generates hydraulic pressure corresponding to the pilot pressure input from the electronic control unit 600, and when the generated hydraulic pressure is supplied to the spool of the control valve 200, the spool moves axially. Accordingly, the flow rate, which is the amount of hydraulic oil supplied to the arm cylinder 50 per unit time, is adjusted to decrease, and the operation speed of the arm cylinder 50 increases slowly.

In other words, when the electronic control unit 600 determines that the speed required for driving the boom 31 exceeds a reference value and thus the boom 31 may not be lifted or lowered following the movement amount of the arm 32, the increase rate of the arm 32 is adjusted to be lower than the first set value so that the boom 31 can keep up with speed of the arm 32.

In the above, an embodiment in which the speed increase rate of the arm 32 changes discontinuously, based on a specific reference value of the speed required for driving the boom 31, has been described. However, the speed increase rate of the arm 32 may change continuously based on the speed required for driving the boom 31.

Specifically, as illustrated in FIG. 7(*b*), when the speed required for driving the boom 31 is smaller than a first reference value, the speed of the arm 32 may be set to increase rapidly according to a value corresponding to 100% of the predetermined arm speed increase rate. In addition, as the speed required for driving the boom 31 increases, the speed increase rate of the arm 32 may be lowered gradually from the initial 100%. Also, when the speed required for driving the boom 31 is greater than a second reference value, the speed of the arm 32 may be set to increase slowly according to a value corresponding to 50% of the predetermined speed increase rate of the arm 32.

The present disclosure is not limited thereto, and the speed increase rate of the arm 32 may be set to decrease gradually as the speed required for driving the boom 31 increases.

Hereinafter, a method for controlling the arm 32 of the electronic control unit 600 in consideration of the moment of inertia of the work machine 30 according to an embodiment of the present disclosure will be described in detail as follows.

When the bucket 33 is in a loaded state or an attachment such as a tilt rotator is mounted on the tip of the arm 32, the moment of inertia for the boom 31 increases. Specifically, referring to FIG. 6, since a tilt rotator 70 is mounted on the tip of the work machine 30 of FIG. 6(*b*) to increase the load on the tip, the moment of inertia for the boom 31 increased as compared to the work machine 30 of FIG. 6(*a*).

Figure 6:
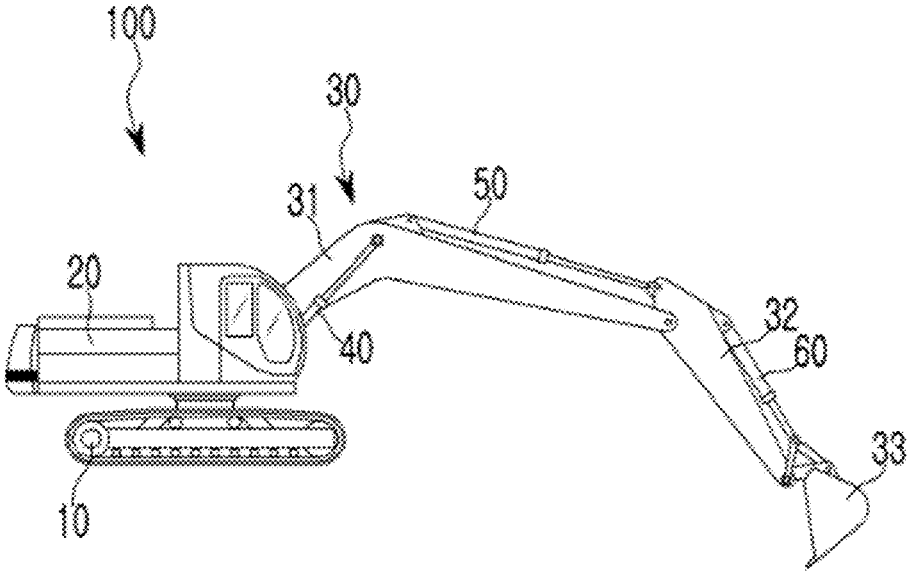
Figure 6:
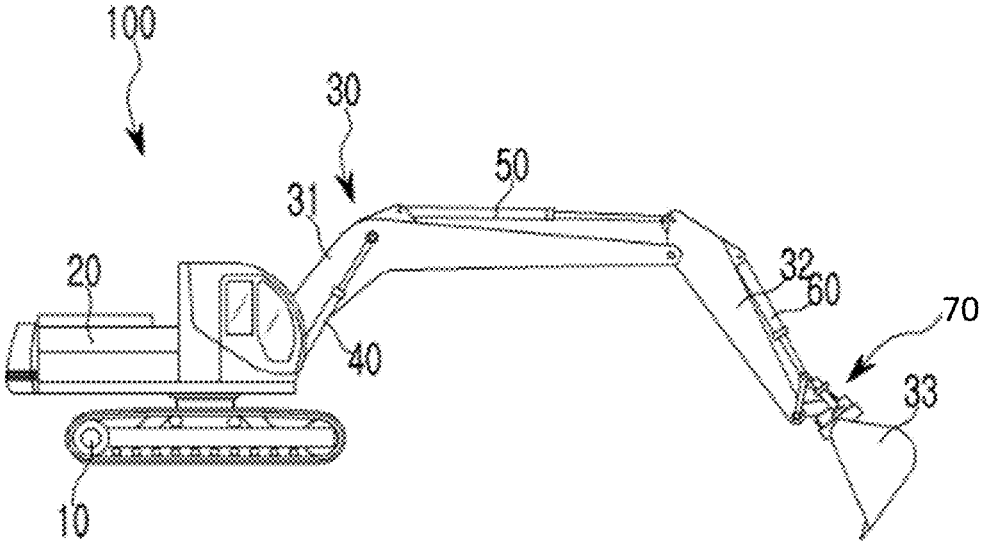

Accordingly, in the work machine 30 of FIG. 6(*b*), when the arm 32 is extended to start grading, the lifting of the boom 31 may not keep up with the speed at which the arm 32 falls due to its own weight.

Therefore, the speed increase rate of the arm 32 may be controlled by additionally considering the moment of inertia of the work machine 30.

First, when the driver operates the boom 31 or arm 32 through the operation lever 400, the information providing unit 500 collects and/or calculates the location information, posture information, and information on moment of inertia of the work machine 30, and the location information of the work surface, and provide the same to the electronic control unit 600. The electronic control unit 600 compares the moment of inertia of the boom 31, arm 32 and bucket 33 provided by the information providing unit 500 with a reference value.

Figure 8:
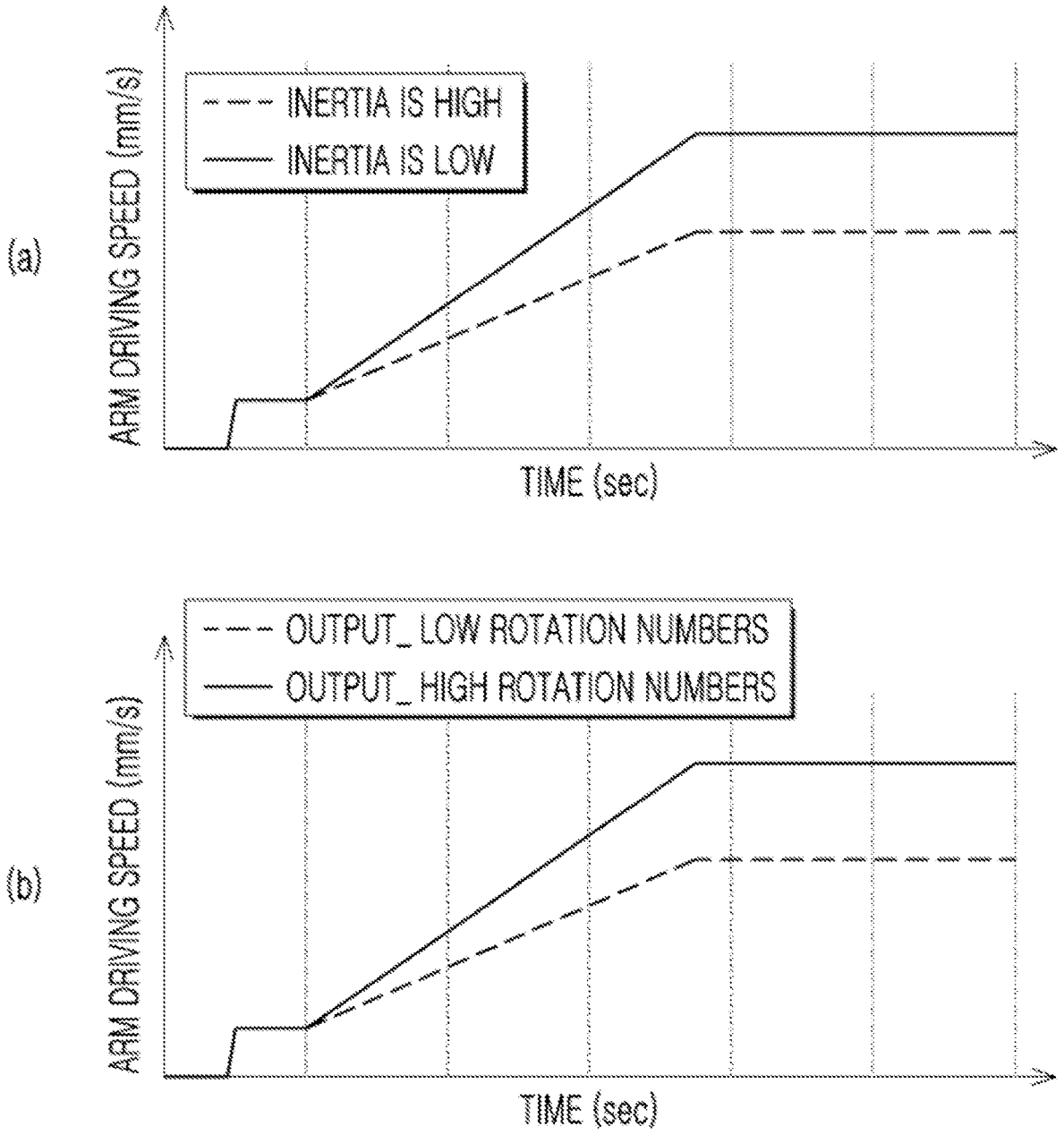

FIG. 8(*a*) illustrates a graph of the speed of the arm 32 according to the operation time of the operation lever 400 according to an embodiment of the present disclosure. When the moment of inertia of the work machine 30 is less than or equal to a reference value, the electronic control unit 600 classifies the arm 32 into a high-speed section in which the arm 32 drives fast according to the predetermined arm speed increase rate, and when the moment of inertia of the work machine 30 exceeds a reference value, the electronic control unit 600 classifies the arm 32 into a low-speed section in which the arm 32 drives slowly according to an arm speed increase rate smaller than the predetermined arm speed increase rate.

Specifically, when the electronic control unit 600 classifies into the high-speed section, the electronic proportional pressure reducing valve 300 generates a hydraulic pressure corresponding to the pilot pressure input from the electronic control unit 600, and when the generated hydraulic pressure is supplied to the spool of the control valve 200, the spool moves axially. Accordingly, the flow rate, which is the amount of hydraulic oil supplied to the arm cylinder 50 per unit time, is adjusted to increase, and the operation speed of the arm cylinder 50 increases rapidly.

In other words, when the electronic control unit 600 determines that the moment of inertia for the boom 31 is small and thus the boom 31 may be lifted or lowered following the movement amount of the arm 32, the speed of the arm 32 is allowed to increase rapidly according to a predetermined second set value.

On the other hand, when the electronic control unit 600 classifies into the low speed section, the electronic proportional pressure reducing valve 300 generates a hydraulic pressure corresponding to the pilot pressure input from the electronic control unit 600, and when the generated hydraulic pressure is supplied to the spool of the control valve 200, the spool moves axially. Accordingly, the flow rate, which is the amount of hydraulic oil supplied to the arm cylinder 50 per unit time, is adjusted to decrease, and the operation speed of the arm cylinder 50 increases slowly.

In other words, when the electronic control unit 600 determines that the moment of inertia for the boom 31 is large and the boom 31 may not be lifted or lowered following the movement amount of the arm 32, the speed increase rate of the arm 32 may be lowered to be lower than the second set value so that the boom 31 can keep up with the speed of the arm 32.

Hereinafter, a method for controlling the arm 32 of the electronic control unit 600 in consideration of the output of the work machine 30 according to an embodiment of the present disclosure will be described in detail.

When the driver performs work selecting standard mode or economy mode for the purpose of improving fuel efficiency, etc., the flow rate, which is the amount of hydraulic oil supplied to the hydraulic cylinder per unit time, is supplied less, and when instantaneous maximum output is required, the boom 4*a* may not be lifted or lowered following the movement amount of the arm 32.

Therefore, the electronic control unit 600 may control the speed increase rate of the arm 32 by additionally considering the input rotation number of the work machine 30.

First, when the driver operates the engine mode switch provided in the operating room to set the mode, and operates the boom 31 or the arm 32 through the operation lever 400, the information providing unit 500 collects and/or calculates the location information, and posture information of the work machine 30, engine maximum output value of the selected mode and the location information of the work surface, and provides the same to the electronic control unit 600. The electronic control unit 600 compares the engine maximum output value of the selected mode with a predetermined reference value.

FIG. 8(*b*) illustrates a graph of the speed of the arm 32 according to the operation time of the operation lever 400 according to an embodiment of the present disclosure. When the engine maximum output value is greater than or equal to a reference value, the electronic control unit 600 classifies the arm 32 into a high-speed section in which the arm 32 is driven fast according to a predetermined arm driving speed increase rate, and when the engine maximum output value is less than a reference value, the electronic control unit 600 classifies the arm 32 into a slow-speed section in which the arm 32 is driven slowly according to an arm speed increase rate smaller than the predetermined arm driving speed increase rate.

The electronic control unit 600 controls the speed increase rate of the arm 32 differently for the low-speed section and the high-speed section as classified above.

Specifically, when the electronic control unit 600 classifies into the high-speed section, the electronic proportional pressure reducing valve 300 generates a hydraulic pressure corresponding to the pilot pressure input from the electronic control unit 600, and when the generated hydraulic pressure is supplied to the spool of the control valve 200, the spool moves axially. Accordingly, the flow rate, which is the amount of hydraulic oil supplied to the arm cylinder 50 per unit time, is adjusted to increase, and the operation speed of the arm cylinder 50 increases rapidly.

In other words, when the electronic control unit 600 determines that the engine maximum output value is large and thus the boom 31 may be lifted or lowered following the movement amount of the arm 32, the speed of the arm 32 is allowed to increase rapidly according to a predetermined third set value.

On the other hand, when the electronic control unit 600 classifies into the low-speed section, the electronic proportional pressure reducing valve 300 generates a hydraulic pressure corresponding to the pilot pressure input from the electronic control unit 600, and when the generated hydraulic pressure is supplied to the spool of to the control valve 200, the spool moves axially. Accordingly, the flow rate, which is the amount of hydraulic oil supplied to the arm cylinder 50 per unit time, is adjusted to decrease, and the operation speed of the arm cylinder 50 increases slowly.

In other words, when the electronic control unit 600 determines that engine maximum output value is low and the boom 31 may not be lifted or lowered following the movement amount of the arm 32, the speed increase rate of the arm 32 is set to be lower than the third set value so that the boom 31 may keep up with the speed of the arm 32.

Hereinafter, a method for controlling the arm 32 of the electronic control unit 600 in consideration of the speed required for driving the boom 31, the moment of inertia of the work machine 30, and the output of the work machine 30 according to an embodiment of the present disclosure will be described in detail as follows.

First, when the driver operates the engine mode switch provided in the operating room to set the mode, and operates the boom 31 or the arm 32 through the operation lever 400, the information providing unit 500 collects and/or calculates the location information, and posture information of the work machine 30, moment of inertia, engine maximum output value of the selected mode and the location information of the work surface, and provides the same to the electronic control unit 600.

The electronic control unit 600 compares the speed required for driving the boom 31 for the provided work surface, the moment of inertia of the work machine 30 and the engine maximum output value with a reference value, respectively, and classifies into high-speed section and low-speed section.

Next, the electronic control unit 600 compares and determines the arm speed increase rate according to the speed required for driving the boom 31, the moment of inertia of the work machine 30 and the engine maximum output value.

Specifically, when the speed required for driving the boom 31 is less than or equal to a reference value, the electronic control unit 600 sets a predetermined first set value as the first arm speed increase rate, and when the speed required for driving the boom 31 exceeds a reference value, the electronic control unit 600 sets a value obtained by multiplying the first set value by the first decrease rate as the first arm speed increase rate.

In addition, when the moment of inertia of the work machine 30 is less than or equal to a reference value, the electronic control unit 600 sets a predetermined second set value as the second arm speed increase rate, and when the moment of inertia of the work device 30 exceeds a reference value, the electronic control unit 600 sets a value obtained by multiplying the second set value by the second decrease rate as the second arm speed increase rate.

In addition, when the engine output is greater than or equal to a reference value, the electronic control unit 600 sets a predetermined third set value as the third arm speed increase rate, and when the engine output is less than a reference value, the electronic control unit 600 sets a value obtained by multiplying the third set value by the third decrease rate as the third arm speed increase rate.

The electronic control unit 600 sets a smallest value among the first arm speed increase rate to the third arm speed increase rate as the arm speed increase rate, and outputs a pilot pressure corresponding thereto, so as to control the flow rate, which is the amount of hydraulic oil supplied to the arm cylinder 50 per unit time, and control the operation speed of the arm cylinder 50.

As such, when a smallest arm speed increase rate is adopted in consideration of all of the speed required for driving the boom 31, the moment of inertia of the work machine 30, and the engine maximum output value, since the boom 31 may be lifted or lowered in accordance with the movement of the arm 32 in various situations, the reliability of the arm 32 speed control may be improved.

However, the present disclosure is not limited thereto, and the electronic control unit 600 may set a value obtained by multiplying any one of the first set value to the third set value by the first decrease rate to the third decrease rate as the arm speed increase rate. In this case, since all of the first decrease rate to the third decrease rate are considered in the arm speed increase rate, the reliability of the arm 32 speed control may be further improved.

Hereinafter, a method for controlling the boom 31 of the electronic control unit 600 in consideration of the speed required for driving the boom 31, the moment of inertia of the work machine 30 and the output of the work machine 30 according to another embodiment of the present disclosure is explained in detail as follows.

First, when the driver operates the engine mode switch provided in the operating room to set the mode, and operates the boom 31 or the arm 32 through the operation lever 400, the information providing unit 500 collects and/or calculates the location information, and posture information of the work machine 30, moment of inertia, engine maximum output value of the selected mode and the location information of the work surface, and provides the same to the electronic control unit 600.

The electronic control unit 600 compares the provided speed required for driving the boom 31 for the provided work surface, the moment of inertia of the work machine 30 and the engine maximum output value with a reference value, respectively, and classifies into high-speed section and low-speed section.

Then, the electronic control unit 600 compares and determines boom speed increase rate according to the speed required for driving the boom 31, the moment of inertia of the work machine 30 and the engine maximum output value.

Specifically, when the speed required for driving the boom 31 is less than or equal to a reference value, the electronic control unit 600 sets a predetermined first set value as the first boom speed increase rate, and when the speed required for driving the boom 31 exceeds a reference value, the electronic control unit 600 sets a value larger than the first set value as the first boom speed increase rate.

In addition, when the moment of inertia of the work machine 30 is less than or equal to a reference value, the electronic control unit 600 sets a predetermined second set value as the second boom speed increase rate, and when the moment of inertia of the work machine 30 exceeds a reference value, the electronic control unit 600 sets a value greater than the second set value is set as the second boom speed increase rate.

In addition, when the engine output is greater than or equal to a reference value, the electronic control unit 600 sets a predetermined third set value as the third boom speed increase rate, and when the engine output is less than a reference value, the electronic control unit 600 sets a value greater than the third set value as the third boom speed increase rate.

Next, the electronic control unit 600 compares and determines the first boom speed increase rate to the third boom speed increase rate according to the speed required for driving the boom 31, the moment of inertia of the work machine 30, and the engine maximum output value, so as to adjust the flow rate, which is the amount of hydraulic oil supplied to the boom cylinder 40 per unit time, and adjust the operation speed of the boom cylinder 40 by calculating and outputting the pilot input according to the largest boom speed increase rate.

As such, when a largest boom speed increase rate is adopted in consideration of all of the speed required for driving the boom 31, the moment of inertia of the work machine 30 and the engine maximum output value, since the boom 31 may be lifted or lowered in accordance with the movement amount of the arm 32 in various situations, the reliability of the boom 31 speed control may be improved.

The foregoing description of the present disclosure has been presented for illustrative purposes, and it is apparent to a person having ordinary skill in the art that the present disclosure can be easily modified into other detailed forms without changing the technical idea or essential features of the present disclosure. Therefore, it should be understood that the forgoing embodiments are by way of example only, and are not intended to limit the present disclosure. For example, each component which has been described as a unitary part can be implemented as distributed parts. Likewise, each component which has been described as distributed parts can also be implemented as a combined part.

The scope of the present disclosure is presented by the accompanying claims, and it should be understood that all changes or modifications derived from the definitions and scopes of the claims and their equivalents fall within the scope of the present disclosure.

DESCRIPTION OF REFERENCE NUMERALS

100: construction equipment
200: control valve
300: electronic proportional pressure reducing valve
400: operation lever
500: information providing unit
600: electronic control unit

What is claimed is:

1. A construction equipment, comprising:
a lower traveling body;
an upper rotating body rotatably supported on the lower traveling body;
a work machine which comprises a boom, an arm, and a bucket operated by their respective hydraulic cylinder, wherein the work machine is supported by the upper rotating body;
a control valve for controlling the hydraulic cylinder;
an electronic proportional pressure reducing valve for controlling a spool of the control valve;
an operation lever for outputting an operation signal corresponding to an operation amount of a driver; and
an electronic control unit (ECU) for calculating and outputting a pilot pressure for the electronic proportional pressure reducing valve,
wherein the electronic control unit controls a speed of the hydraulic cylinder by using the operation signal of the operation lever and information related to the work machine; wherein the electronic control unit receives at least one of a speed required for driving the boom, a moment of inertia of the work machine, and an engine maximum output, wherein the moment of inertia of the work machine includes the moment of inertia of at least one of the boom, the arm, or the bucket of the work machine;
wherein the electronic control unit compares the moment of inertia of the work machine with a reference value;
wherein the electronic control unit sets a set value as an arm speed increase rate when the moment of inertia of the work machine is less than or equal to the reference value, and reduces the arm speed increase rate when the moment of inertia of the work machine exceeds the reference value.

2. A construction equipment, comprising:
a lower traveling body;
an upper rotating body rotatably supported on the lower traveling body;
a work machine which comprises a boom, an arm, and a bucket operated by their respective hydraulic cylinder, wherein the work machine is supported by the upper rotating body;
a control valve for controlling the hydraulic cylinder;
an electronic proportional pressure reducing valve for controlling a spool of the control valve;
an operation lever for outputting an operation signal corresponding to an operation amount of a driver; and
an electronic control unit (ECU) for calculating and outputting a pilot pressure for the electronic proportional pressure reducing valve,
wherein the electronic control unit controls a speed of the hydraulic cylinder by using the operation signal of the operation lever and information related to the work machine,
wherein the electronic control unit receives at least one of a speed required for driving the boom, a moment of inertia of the work machine, and an engine maximum output, wherein the moment of inertia of the work machine includes the moment of inertia of at least one of the boom, the arm, or the bucket of the work machine,
wherein the electronic control unit compares the engine maximum output with a reference value,
wherein the electronic control unit sets a predetermined set value as an arm speed increase rate when the engine maximum output is greater than or equal to the reference value, and reduces the arm speed increase rate when the engine maximum output is less than the reference value.

3. A construction equipment, comprising:
a lower traveling body;
an upper rotating body rotatably supported on the lower traveling body;
a work machine which comprises a boom, an arm, and a bucket operated by their respective hydraulic cylinder, wherein the work machine is supported by the upper rotating body;
a control valve for controlling the hydraulic cylinder;
an electronic proportional pressure reducing valve for controlling a spool of the control valve;
an operation lever for outputting an operation signal corresponding to an operation amount of a driver; and
an electronic control unit (ECU) for calculating and outputting a pilot pressure for the electronic proportional pressure reducing valve,
wherein the electronic control unit controls a speed of the hydraulic cylinder by using the operation signal of the operation lever and information related to the work machine,
wherein the electronic control unit receives a speed required for driving the boom, a moment of inertia of the work machine, and an engine maximum output, wherein the moment of inertia of the work machine includes the moment of inertia of at least one of the boom, the arm, or the bucket of the work machine,
the electronic control unit compares the speed required for driving the boom, the moment of inertia of the work machine, and the engine maximum output with a reference value,
the electronic control unit sets a first set value as a first arm speed increase rate when the speed required for driving the boom is less than or equal to the reference value, and the electronic control unit sets a value obtained by multiplying the first set value by a first decrease rate as the first arm speed increase rate when the speed required for driving the boom exceeds the reference value, the electronic control unit sets a second set value as a second arm speed increase rate when the moment of inertia of the work machine is less than or equal to the reference value, and the electronic control unit sets a value obtained by multiplying the second set value by a second decrease rate as the second arm speed increase rate when the moment of inertia of the work machine exceeds the reference value, and the electronic control unit sets a third set value as a third arm speed increase rate when the engine maximum output is greater than or equal to the reference value, and the electronic control unit sets a value obtained by multiplying the third set value by a third decrease rate as the third arm speed increase rate when the engine maximum output is less than the reference value.

4. The construction equipment of claim 3, wherein the electronic control unit sets a smallest value among the first arm speed increase rate, the second arm speed increase rate, and the third arm speed increase rate as the arm speed increase rate.

5. The construction equipment of claim 3, wherein the electronic control unit sets a value obtained by multiplying any one of the first set value to the third set value by the first decrease rate to the third decrease rate as an arm speed increase rate.

6. A construction equipment, comprising:

a lower traveling body;

an upper rotating body rotatably supported on the lower traveling body;

a work machine which comprises a boom, an arm, and a bucket operated by their respective hydraulic cylinder, wherein the work machine is supported by the upper rotating body;

a control valve for controlling the hydraulic cylinder;

an electronic proportional pressure reducing valve for controlling a spool of the control valve;

an operation lever for outputting an operation signal corresponding to an operation amount of a driver; and an electronic control unit (ECU) for calculating and outputting a pilot pressure for the electronic proportional pressure reducing valve, wherein the electronic control unit controls a speed of the hydraulic cylinder by using the operation signal of the operation lever and information related to the work machine, wherein the electronic control unit receives a speed required for driving the boom, a moment of inertia of the work machine, and an engine maximum output, wherein the moment of inertia of the work machine includes the moment of inertia of at least one of the boom, the arm, or the bucket of the work machine, the electronic control unit compares the speed required for driving the boom, the moment of inertia of the work machine, and the engine maximum output with a reference value, the electronic control unit sets a first set value as a first boom speed increase rate when the speed required for driving the boom is less than or equal to the reference value, and increases the first boom speed increase rate when the speed required for driving the boom exceeds the reference value, the electronic control unit sets a second set value as a second boom speed increase rate when the moment of inertia of the work machine is less than or equal to the reference value, and the electronic control unit increases the second boom speed increase rate when the moment of inertia of the work machine exceeds the reference value, and the electronic control unit sets a third set value as a third boom speed increase rate when the engine maximum output is greater than or equal to the reference value, and increases the third boom speed increase rate when the engine maximum output is less than the reference value.

7. The construction equipment of claim 6, wherein the electronic control unit sets a largest value among the first boom speed increase rate, the second boom speed increase rate, and the third boom speed increase rate as the boom speed increase rate.

* * * * *